US009598873B1

(12) United States Patent
Cali

(10) Patent No.: US 9,598,873 B1
(45) Date of Patent: Mar. 21, 2017

(54) TEMPORARY PORTABLE ABATEMENT, REMEDIATION, DEMOLITION, AND REMODELING DOOR

(71) Applicant: John E. Cali, Bradenton, FL (US)

(72) Inventor: John E. Cali, Bradenton, FL (US)

( * ) Notice: Subject to any disclaimer, the term of this patent is extended or adjusted under 35 U.S.C. 154(b) by 0 days.

(21) Appl. No.: 14/745,369

(22) Filed: Jun. 19, 2015

(51) Int. Cl.

| | |
|---|---|
| ***E04G 21/24*** | (2006.01) |
| ***E06B 9/06*** | (2006.01) |
| ***E06B 9/01*** | (2006.01) |
| ***E06B 7/18*** | (2006.01) |
| ***E04G 21/30*** | (2006.01) |

(52) U.S. Cl.
CPC ..... *E04G 21/243* (2013.01); *E04G 21/24* (2013.01); *E04G 21/30* (2013.01); *E06B 7/18* (2013.01); *E06B 9/01* (2013.01); *E06B 9/06* (2013.01); *E06B 2009/015* (2013.01); *Y10S 52/12* (2013.01)

(58) Field of Classification Search
CPC ..... E04G 21/243; E04G 21/30; E04G 21/24; Y10S 52/12; A47H 21/00
See application file for complete search history.

(56) References Cited

U.S. PATENT DOCUMENTS 2,855,037 A * 10/1958 Stiffel ..... F16B 12/02 15/268
3,593,474 A * 7/1971 Neels ..... B44C 3/12 52/223.7
4,706,551 A * 11/1987 Schofield ..... B08B 15/026 135/117
5,088,511 A * 2/1992 Bain ..... B08B 15/026 134/200
5,231,809 A * 8/1993 Benjamino ..... B60P 3/32 135/117
5,345,989 A * 9/1994 Brophy ..... A47H 21/00 160/354
5,457,922 A * 10/1995 Fara ..... E04G 21/24 312/1
5,685,112 A * 11/1997 Fara ..... E04G 21/24 312/1
5,803,653 A * 9/1998 Zuffetti ..... E04B 2/7457 248/188.5

(Continued)

*Primary Examiner* — Justin Rephann
(74) *Attorney, Agent, or Firm* — Dorthy S. Morse

(57) ABSTRACT

A reusable and portable temporary door/frame assembly primarily used in abatement, remediation, demolition, and remodeling applications with a containment enclosure or barrier to allow quick and easy ingress/egress, or restrict movement, to/from a limited access area. The assembly comprises lightweight materials, such as but not limited to plastic or aluminum, and two non-spring-loaded telescopic poles that extend a top bar/piece upwardly for attachment to an overhead door frame, header, or ceiling. The top of the frame is also configured to accept two upwardly extendable spring-loaded/biased poles allowing a containment enclosure or barrier to be built to ceiling heights beyond the reach of the integral telescopic poles. Since the assembly is portable, it can be installed to open inwardly, outwardly, and is reversible, depending on convenience or need. The door is lockable. The door panel's frame includes a seal at the top/bottom to reduce air transmission to/from the limited access area.

20 Claims, 8 Drawing Sheets

(56) References Cited

U.S. PATENT DOCUMENTS 5,924,469 A * 7/1999 Whittemore ..... A47H 21/00 160/351
6,266,939 B1 * 7/2001 Yates ..... E04F 21/00 52/741.1
6,383,242 B1 * 5/2002 Rogers ..... B01D 46/42 454/63
7,188,636 B1 * 3/2007 Kanne ..... B08B 15/02 135/142
7,261,140 B2 8/2007 Whittemore
7,658,219 B2 * 2/2010 Whittemore ..... E04G 21/24 160/351
8,074,700 B1 * 12/2011 Melino ..... E04G 21/30 160/327
8,177,692 B2 * 5/2012 Deppen ..... A63B 21/0728 434/226
8,839,592 B2 * 9/2014 Foran ..... E04G 21/243 52/782.1
8,875,772 B1 11/2014 Dixon, Jr.
8,875,774 B1 * 11/2014 Flores ..... E04G 21/30 160/351
2002/0152703 A1 * 10/2002 Dunks ..... E04C 2/296 52/506.01
2003/0024189 A1 * 2/2003 Hughes ..... E04G 21/24 52/271
2004/0065799 A1 * 4/2004 Whittemore ..... E04G 21/243 248/354.1
2006/0283562 A1 12/2006 Hickey
2009/0133354 A1 * 5/2009 Spear ..... E04B 2/7453 52/588.1
2009/0194959 A1 * 8/2009 Mintie ..... B62B 3/02 280/47.131
2009/0307990 A1 * 12/2009 Muehlebach ..... E04B 2/822 52/63
2012/0006498 A1 1/2012 Potter
2014/0075851 A1 * 3/2014 Rhines ..... E04B 2/72 52/63

* cited by examiner

TEMPORARY PORTABLE ABATEMENT, REMEDIATION, DEMOLITION, AND REMODELING DOOR

CROSS-REFERENCES TO RELATED APPLICATIONS

None

BACKGROUND OF THE INVENTION

Field of the Invention

The invention relates to doors, specifically to a reusable and portable temporary door and frame assembly primarily used in abatement, remediation, demolition, and remodeling applications (such as for dust containment and the elimination of mold, asbestos, or lead, but not limited thereto). It is typically employed with a temporary containment wall, temporary containment enclosure, existing doorway, entrance, or other enlarged wall opening adjacent to a limited access area to allow quick and easy ingress and egress to/from the limited access area within which it is desired to contain construction debris, drywall dust, or other materials having a potential health risk or otherwise causing a difficult, time-consuming, and/or expensive clean up process if not contained. Once the present invention is installed, which typically takes one person less than 10 minutes, there is no bending, stretching, ducking, or tripping hazard while users attempt to pass through it to go from one side of the present invention door/frame assembly to the other, as is often encountered with prior art entrance openings created by temporary zippered devices. The present invention door/frame assembly comprises lightweight materials, such as but not limited to plastic or aluminum, and integral to its outer door frame are two non-spring-loaded telescopic poles that may be extended upwardly to raise a top bar/piece for attachment to an overhead portion of a permanent door frame, header, or ceiling. It is preferred that the non-spring-loaded telescopic poles have a locking feature, such as but not limited to a simple locking pin inserted into a set of spaced-apart holes or a ratcheting/locking mechanism, and the top bar supported by the telescopic poles may have holes for fastener attachment to a ceiling or other surface above it, or the bar may be secured in place by double face, preservation, or Ezier™ tape, or other means. In addition, the non-spring-loaded telescopic poles are removable from the top portion of the assembly's outer frame portion, and two upwardly and currently marketed extendable Zipwall® poles (or other tensioned product) may be substituted, easily allowing use of the present invention door/frame assembly with a containment wall or enclosure built to ceiling heights beyond the reach of the present invention's integral non-spring-loaded telescopic poles, making the present invention assembly even more versatile. In addition, since the present invention assembly is portable, it can be installed to open both inwardly and outwardly, and is easily reversible for left or right hand swing, depending on convenience or need. The door of the most preferred embodiment of the present invention assembly is also lockable to prevent unauthorized entry to a limited access area where hazardous materials may be present, and the frame of the door hinged to the present invention's outer frame portion also preferably includes top and bottom seals to further reduce air transmission to/from the limited access area.

Description of the Related Art

Dust/debris partitions, barriers, panels, and doors are known, and applications include, but are not limited to, devices employed in and for hospital clean rooms, loading docks, coal mines, and construction dust and debris containment. For example, published U.S. patent application 2005/0247414 to Whittmore (2005) discloses a partition mount with integrated plunger system wherein multiple telescoping poles each engage the edge of a temporary protective sheet/partition in different locations against a ceiling. If the sheet/partition extends from ceiling-to-floor, and between opposing walls in a room (or between the opposed edges of a wall opening), a protective barrier can be quickly installed. However, the present invention disclosed herein is different from the Whittmore invention, as the present invention would not form a protective barrier/partition, but instead provide an easily used access entryway (but sturdy and lockable) to/from a confined area separated by the partition formed using the Whittmore invention. The Whittmore invention is currently sold under the name of Zipwall®, which advertises that it can be used to install a protective barrier or partition in under ten minutes. Zippers are usually provided for entry through the Zipwall® barrier/partition. Other examples of dust/debris partitions, barriers, panels, and doors include the "roll-down" dust protection door disclosed in published U.S. patent application 2006/0283652 to Hickey (2006), the barrier with decorative interchangeable panels disclosed in FIG. 5B of published U.S. patent application 2012/0006498 to Potter (2012) that also has top and bottom outwardly-biased telescoping features that are used to secure it between a ceiling and floor, and the access door to a baseball batting cage or other similar structure disclosed in U.S. Pat. No. 8,875,772 to Dixon, Jr. (2014). However, all have structure that is distinctively different from the present invention reusable and portable temporary door and frame assembly, and less versatile for abatement, remediation, demolition, and remodeling worksites.

Another product generally providing the same containment area access function as the present invention is the Zipwall® Standard Doorway Dust Containment Kit, which is currently sold and provides a plastic sheet having dimensions approximately 3-feet wide by 7-feet tall, and two pre-installed zippers glued to the sheet for ingress and egress from one side of the sheet to the other after installation in a doorway entrance. A roll of double-sided tape is also included in the kit for use in sealing the sheet to the doorway entrance perimeter or adjacent wall surfaces. A disadvantage of the Zipwall® doorway kit is that each time a person needs to move through the doorway entrance it creates when its zipper is open, that person has to bend down all the way to the floor, grip the zipper with one hand and hold the flexible plastic sheet with the other hand, and then stretch sufficiently upward to raise the zipper above their head and create a suitably large access opening, move through the opening made and immediately thereafter reverse the process from the other side to close the opening all the way to the floor, which doubles the amount of bending and stretching that must occur for each entry and exit to/from a limited access area protected by a temporary containment barrier or enclosure. Such a doorway barrier is inconvenient if access to the confined area it protects is needed hundreds of times in a day, which typically occurs in abatement and remediation activity involving multiple construction workers, technicians, supervisors, and inspectors. Also, it is inconvenient and sometimes awkward for a person carrying a load, or otherwise encumbered, to move into or out of a confined area through a zippered Zipwall® doorway entrance, and the thin flexible sheet taped to the floor on both sides of the zippered entrance opening can potentially become a tripping hazard. In addition, a zippered partition/barrier is not wheelchair accessible, and it is not easy to secure/lock to keep out unauthorized people, children, or pets. Although the prior art zipper door could be installed upside down with the zipper tab at the top in a closed door application, and this would eliminate the risk of access into the containment area by pets and crawling children/toddlers, technicians and others having a need to repeatedly enter and exit the containment area would have an increased likelihood of tripping over the upside down installed prior art zipper device and sustaining an injury. In contrast, the present invention assembly overcomes all of these disadvantages, and it is easy to use, opens both inwardly and outwardly, is reversible for left or right hand swing depending on convenience or need, and it provides superior entrance protection to that of the known prior art while preventing all unauthorized entry into a hazardous environment or until post remediation testing is performed and a clearance certificate is received. There is no known invention having structure similar to that in the present invention, or providing the same benefits and advantages.

The importance of and advantages provided by the present invention door/frame assembly over the less secure zippered doorway entrances are further illustrated by examples given below, and by the fact that in most abatement, remediation, demolition, and remodeling work it is common for hidden dangers to be discovered as work progresses, making it difficult for project managers and technicians to predict and give notice in advance to owners and tenants about all potential dangers that will be present. Thus, the exclusion of unauthorized people and pets from active abatement, remediation, demolition, and remodeling worksites is a serious and important objective, and the best available precautions should be taken. When zippered entranceways are used, unauthorized people and pets cannot always be kept out of hazardous work areas, or those areas where work appears complete but the areas have not yet received post remediation testing and a clearance certificate. Sometimes owners are to blame and purposefully enter an area they know to be restricted, unaware of all potential dangers present. Sometimes the unauthorized entry is unexpected and innocent, such as by an unsupervised and curious child or pet. The following are examples of hazardous situations which have occurred, or could potentially occur, most of which would be avoided by use of the present invention door/frame assembly which is sufficiently versatile for use with most temporary containment enclosures and barriers employed in abatement, remediation, demolition, and remodeling work.

In two known situations, a sight impaired owner's pet and a hearing impaired pet were each able to maneuver themselves through a prior art zippered doorway and enter a restricted containment area. One pet became disoriented from background sounds outside the containment area and/or by the equipment running inside the containment area, and the other pet could not see to find the prior art zippered doorway opening in order to exit. Since both pets became stressed by their inability to exit the containment area on their own, and in an attempt to prevent further stress to their pets, their owners thereafter choose to leave the zipper doorway entrance open for their pets to pass into and out of the containment area at will. However, in doing so the pet owners unthinkingly exposed themselves and others in the household to possible health risks, by the mixing of air in the containment area with that in other areas of their home, even after being advised in advance about the importance of keeping the zippered door entranceway completely closed at all times.

Crawling children and curious toddlers are also at risk when zippered doors are used in temporary containment barriers and enclosures, as the means to open them is at floor/eye level and within their reach, and once breaching the barrier or enclosure they would encounter many small, sharp, shiny, and new objects they had never seen before that although extremely dangerous would create an attractive nuisance for them, enticing them to investigate and handle, and possibly taste or ingest. Toddlers left unsupervised for even one minute could easily unzip and enter the containment area, also possibly exposing themselves to hazardous mold spores, asbestos, lead, exposed wires posing an electrocution hazard, open containers containing water and other liquids, many falling and tripping hazards, and other dangers. They could also be injured by falling from an open stairwell, into recessed showers, or through sections of a bathroom where sewage contaminated sub-flooring had been removed in the multi story floor system of a home, condominium, or apartment. In addition, when repairs are made to bathrooms encountering water and/or damage from overflowing toilets, it is required that the toilets be detached so that a thorough cleaning/sanitizing can occur for the entire surrounding concrete floor, tile or other impervious floors surfaces adjacent to the toilet, as well as the area below the toilet itself. Thus, while such areas remain contaminated and unguarded, the hands of a crawling child within a containment enclosure could easily come in contact with the toilet bowl flange, the inside of sewer pipe, and/or sewage contaminated floors containing high levels of bacteria, possible HIV and hepatitis A or B viruses, and/or other pathogens. Once on the child's hands, the pathogens may be ingested with the child subsequently becoming ill, even contracting a disease that could lead to its death. In contrast, when the present invention door/frame assembly in its closed and locked position is used with a temporary enclosure or barrier for abatement, remediation, demolition, and remodeling work, it is impenetrable by young children who learn early that closed doors block their path and prevent entry. Thus, it is unlikely that they would makes further entry attempts once they encountered the closed present invention door and/or found it locked. However, children also are taught early to open and close things, including zippers, so a zippered door entryway at floor level in a temporary containment enclosure or barrier that is encountered is familiar, and easily opened by many children. Although a zippered entranceway to an unattended containment area could be blocked with a large object, it is not easily locked in the same manner as the present invention door/frame assembly.

Another potential hazard to children and pets in abatement, remediation, demolition, and remodeling projects involves second story toilet overflow, that requires the sewage affected and/or mold contaminated sub-flooring to be removed along with the wet first floor drywall ceiling below. This leaves the upper bathroom floor open to the ceiling of the room below, with each room now exposed to the other. A pet or a child entering a containment area with such hazard through an un-lockable prior art zippered entranceway (located at floor level and within their reach) might then unwittingly fall through the newly opened floor system to the room below, causing it serious injury or death. Also, many children are attracted to water. On its website the United States Consumer Product Safety Commission acknowledges young children are at risk around water, and that between 1996 and 1999 it received reports of 459 young children drowning in bathtubs, buckets, toilets, spas and hot tubs, and other containers holding liquid. Another hazard to children and pets in unattended containment areas is dehumidification equipment that may cause ambient temperatures within the containment area to rise to 120-degrees Fahrenheit, or higher. If a pet or young child entered a containment area unattended where temperatures of 120-degrees Fahrenheit, or higher, were present, a devastating injury or loss of life could occur in as little as 20 minutes. The National Highway Safety Administration website has information relating to children left unattended in hot cars, with a general consensus of Internet information stating that very high body temperatures can lead to brain damage, damage of vital organs, heat stroke, and death. Once the body's sweating mechanism fails, body temperature can rise to 106-degrees Fahrenheit in 10-15 minutes. The present invention prevents the unsupervised entry of pets and children into containment areas better than prior art zippered doorway entrances, and the other information presented hereinabove demonstrated that there is an unfulfilled need that can be resolved by use of the present invention in current abatement, remediation, demolition, or remodeling work.

Once children and pets access an abatement, remediation, demolition, or remodeling containment area, they might be exposed to anything from sharp objects, carpet tack strips, sharp edges on metal studs, glass, demolition or construction debris, electric power tools, exposed electric outlets with the covers removed during demolition, tubs, spas and hot tubs, buckets containing liquids, and toilets still in place that may still contain water. All pose serious risks to unsupervised children and pets. Thus, containment areas are always a dangerous environment for children, pets, and others not fully appreciating the hazards present, and substituting the present invention door/frame assembly for a prior art zippered entranceway significantly reduces the risk of occurrence for the potential tragedies described above. Even one curious child being saved by use of the present invention, would provide a great benefit.

SUMMARY OF THE INVENTION

The primary objective of this invention is to provide a reusable and portable temporary door/frame assembly for abatement, remediation, demolition, and remodeling applications (such as for dust containment, limiting access to temporary structural and material hazards, and the elimination of mold, asbestos, or lead, but not limited thereto), which is used with a temporary containment enclosure or barrier to allow quick/easy ingress and egress to/from limited access areas where containment of construction debris, drywall dust, mold, or other potentially harmful structural hazards and materials is desired. It is also an objective of this invention to provide an enhanced temporary door system which can be installed by one person in less than 10 minutes. A further object of this invention is to provide a reusable and portable temporary door/frame assembly that allows easy passage through it without bending, stretching, ducking, or a tripping hazard. Additionally, it is an objective of this invention to provide means for easy ingress/egress by owners or emergency personnel through a containment enclosure or barrier, in order to access unaffected bedrooms, etc. during the remodeling and/or remediation processes, or for prompt escape from a containment area in the event of a fire or other emergency. It is also an objective of this invention to provide a temporary door/frame assembly that is adaptable to containment walls and enclosures of differing height. In addition, it is an objective of this invention to provide a temporary door/frame assembly that may open inwardly or outwardly, and is reversible for left or right hand swing, depending on convenience or need. It is also an objective of this invention to provide a temporary door/frame assembly that is easy to secure/lock to keep out unauthorized people until post remediation testing has been performed and a clearance certificate has been provided. A further objective of this invention is to provide a temporary door/frame assembly that can be sealed top and bottom to further reduce air transmission to/from the limited access containment area.

The door/frame assembly of the present invention does not require assembly and is easily installed into a permanent entrance opening or a section of a temporary containment enclosure wall or containment barrier. It also can be secured at the top to an overhead structure, such as but not limited to a ceiling and preferably with screws, preservation tape, Ezier™ tape, and/or other fastening means after extending its two non-biased poles telescopically upward from the opposed sides of the top surface of its outer door frame upward to the ceiling or other surface, to a maximum height of approximately eleven feet. For use with containment areas having a greater height dimension, two prior art and widely available spring-loaded/biased telescoping accessories replacing its two non-biased telescoping poles can be employed for a pressured/upwardly-biased connection of the top of the present invention's outer frame portion to an overhead surface. The bottom strip (aluminum or other material) on the outer frame portion of the present invention can be stabilized by securing it with preservation tape, Ezier™ tape, and/or other fastening means to the supporting floor or other surface. Also, the sides of the present invention's outer frame portion can be attached/sealed directly to the plastic of a temporary containment enclosure or barrier, or to a structural opening, or to one or more sections of plastic barrier sheet that can be sealed in a secure manner with tape to a door frame, walkway, or temporary barrier/enclosure opening. Once it is installed, the present invention door/frame assembly allows ingress/egress of the mold/asbestos/lead or construction technician into/from a properly built containment structure/area without the inconvenience and time delay of opening and closing a zipper each time high overhead, then fully to the floor for proper closure. The present invention door/frame assembly also allows easier transport of large items in and out of the confined containment area, such as might occur during remodeling. Furthermore, if used repeatedly, its cost will soon be recovered over the repeat expense of purchasing disposable zippered doorway kits. The present invention further allows for easy access in and out of the containment structure/area to demo, clean, deliver and remove hazardous materials, set equipment, deliver and remove supplies and other materials, and for prompt emergency evacuation of the containment structure/area if ever needed.

Use of the present invention door/frame assembly in lieu of a standard zipper or double zippered entrance eliminates the necessity for a technician to bend over, all the way to the floor each and every time, to unzip, enter, and then close the zipper again all the way to the floor. This protocol must be maintained in order to minimize cross contamination and not compromise the air quality inside or outside a containment area. A zipper in a containment structure/area could be opened and closed hundreds of times in eight hours, adding stress on a technician's back, legs, and knees above and beyond what is endured during the actual abatement, remediation, demolition, and/or remodeling work. Also when the present invention door/frame assembly is used, an owner/tenant/occupant needing to enter and exit, or pass through the containment area, if applicable and when appropriate or allowable (for example after post remediation testing is performed and a clearance certificate is received, and while rebuilding is going on), can do so without the liability of trip and fall hazard that could otherwise occur by his/her arm or leg, or a portion of a carried load, inadvertently engaging the edge of a plastic barrier sheet that is taped at floor level on either side of an zippered entrance opening. In addition, the present invention assembly is portable, it can be installed to open inwardly or outwardly, and for left or right hand swing, depending on convenience or need. A door lock is an option to prevent entry into a protected hazardous environment until post remediation testing is performed and a clearance certificate is received, and a door closure means can also be employed as a part of the present invention door/frame assembly to minimize delay for technician ingress/egress. The frame of the door panel hinged to the present invention's outer frame portion also preferably includes a seal at the top/bottom to reduce air transmission to/from the associated limited access area. Furthermore, although the present invention door/frame assembly has a door frame hinged to its outer frame portion and the door panel is fixed to its door frame by screws, rivets, welding, or other means, the door panel and its frame are typically non-transparent and non-removable by a user after installation. However, when desired or useful in an application, the door panel and/or frame can be made from transparent or translucent materials. No invention is known with structure similar to that in the present invention, or to provide its same benefits and advantages.

COMPONENT LIST

1—Temporary Opening
2—Permanent Door Frame or Interior Perimeter Surface of Walkway Opening
3—Temporary Barrier or Flexible Sheet Barrier
4—Zipper Closure in Temporary Barrier 3
5—Temporary Portable Abatement, Remediation, Demolition, and Remodeling Door/Frame Assembly
6—Outer Frame Portion of Door/Frame Assembly 5
7—Door Frame Part hinged to the Outer Frame Portion 6 of Door/Frame Assembly 5
7A Front surface of Door Frame Part 7
7B—Back surface of Door Frame Part 7
8—Central Panel secured to Door Frame Part 7 [the Door portion of Door/'Frame Assembly 5 comprises Central Panel 8 and Door Frame Part 7]
9—Exterior Door Knob or Handle with key
10—Hinge
11—Interior Door Knob or Handle with lockable mechanism
12—Non-biased Top Extension of Door/Frame Assembly 5
13—Top Bar of Top Extension 12
14—Vertical Side Members of Top Extension 12
15—Seals used on the top and bottom ends of the Door Frame Part 7 of Door/Frame Assembly 5
16—Lock Pin used with Holes 19 to secure the Top Extension 12 in opened and closed positions
17—Prior art spring-loaded/biased Telescoping Poles optionally replacing Top Extension 12, which can include barrier securing top pads or barrier securing elongated top foam rails
18—Double Face Tape used to secure a flexible Temporary Barrier 3 to the Outer Frame Portion 6 of Door/Frame Assembly 5

19—Holes in Vertical Side Members 14 receiving a Lock Pin 16, or the location of a ratcheting mechanism

DETAILED DESCRIPTION OF THE INVENTION

Figure 1:
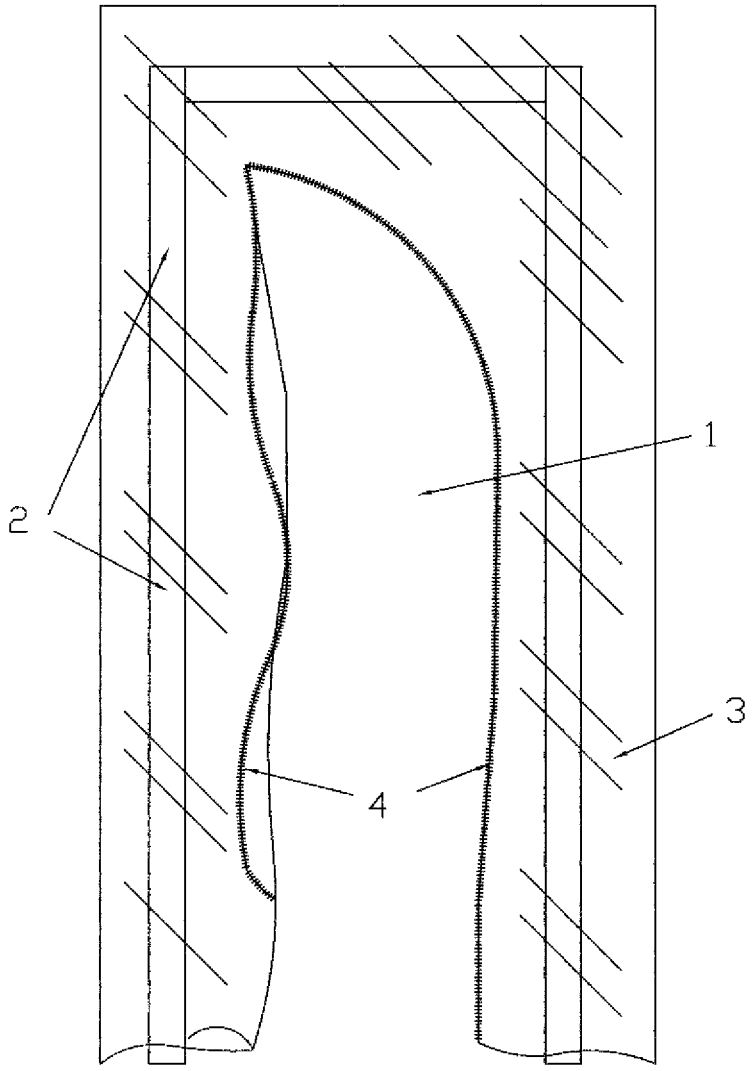
FIG. 1 PRIOR ART
FIG. 1 is a front view of a prior art zippered barrier installed across a doorway entrance to a containment area or other limited access area, with its generally upwardly opening zipper in an opened position.
Figure 1A:
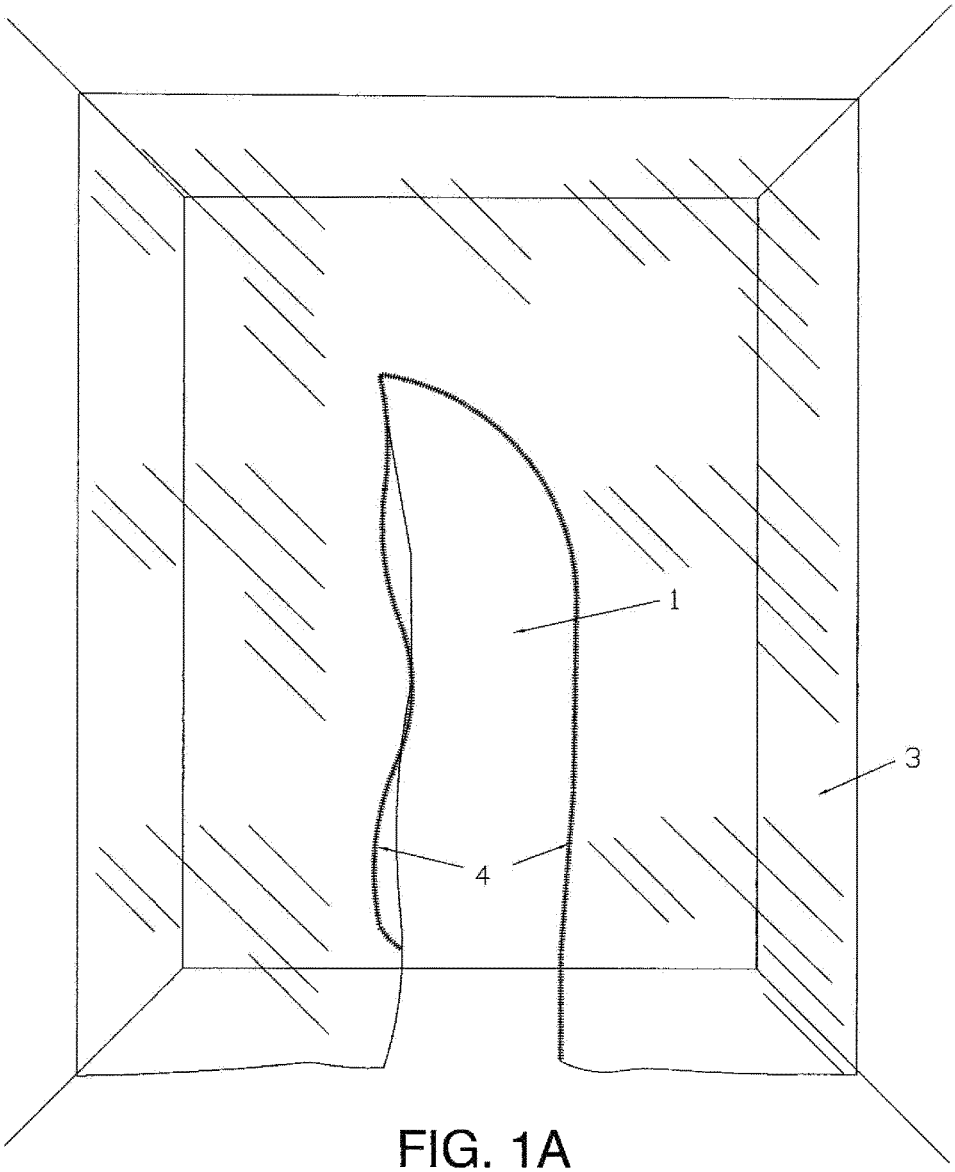
FIG. 1A PRIOR ART
FIG. 1A is a front view of a prior art zippered barrier installed floor-to-ceiling and across the opposing walls of a room, creating a containment area on the remote side of the barrier.

The present invention is a reusable and portable temporary door and frame assembly 5 primarily used in abatement, remediation, demolition, and remodeling applications (such as for dust containment and the elimination of mold, asbestos, or lead, but not limited thereto), which is used with a wall of a temporary containment enclosure or barrier (see the number 3 in FIGS. 1, 1A, 7, and 8, or other) to allow quick and easy ingress and egress, without bending, stretching, ducking, or a tripping hazard, to/from limited access areas where containment therein of construction debris, drywall dust, mold, asbestos, or other potentially dangerous or hazardous materials is desired. The present invention assembly 5 comprises lightweight materials, such as but not limited to plastic or aluminum, and integral to its outer frame portion 6 are two non-spring-loaded telescopic poles (side members 14) that extend a top bar/piece 13 upwardly and away from the assembly's outer frame 6 for attachment to n overhead portion of a permanent door frame, header, or ceiling (such as but not limited to those shown in FIGS. 1 and 1A). The lateral portions of the top surface of the present invention outer frame portion 6 is also configured to accept one or more upwardly extendable Zipwall® poles (or other spring-loaded/biased product), allowing a temporary containment enclosure or barrier 3 to be built to ceiling heights beyond the approximate eleven foot reach of the present invention's integral non-biased telescopic poles (the side members 14 of non-spring-loaded top extension 12). In addition, since the present invention assembly 5 is portable, it can be installed to open inwardly, or outwardly, for left or right hand swing, depending on convenience or need. A door lock is an option, as a part of interior door knob or handle 11, exterior door knob or handle 9, and/or deadbolt lock, or otherwise (not shown). Also, the top and bottom portions of the present invention frame 7 around door panel 8 each have a seal 15 to reduce air transmission to/from the associated limited access area (such as but not limited to that shown in FIGS. 1 and 1A). FIGS. 1 and 1A show an installed prior art temporary zippered barrier 3, while FIGS. 2A-8 show various views of the present invention temporary portable abatement/remediation/demolition/remodeling door/frame assembly 5.

FIGS. 1 and 1A respectively are front views of a prior art temporary zippered barrier 3 installed across a door frame 2 and installed floor-to-ceiling and across the opposing walls (not separately numbered) of a room, creating a containment area on the remote side of the temporary barrier 3. Although not limited thereto, it is contemplated in many applications for temporary barrier 3 to be a flexible sheet that is discarded at the end of abatement or remediation activity (with or without a preliminary decontamination step, according to need). The means of sealing the edges of the temporary zippered barrier 3 in place (with double-sided tape or other means) is not in revealed in FIGS. 1 and 1A. In addition, FIGS. 1 and 1A show the zippered closure 4 of barrier 3 in an open configuration, creating a doorway entrance 1 for ingress and egress to/from a limited access containment area. Frequent entry and exit through a doorway entrance 1 created by a zippered closure 4 is inconvenient, involves bending and stretching, is time consuming and slows progress into and from a containment area, and can provide tripping and other hazard for those carrying loads into and from a containment area, and those otherwise encumbered or restricted in mobility.

Figure 2A:
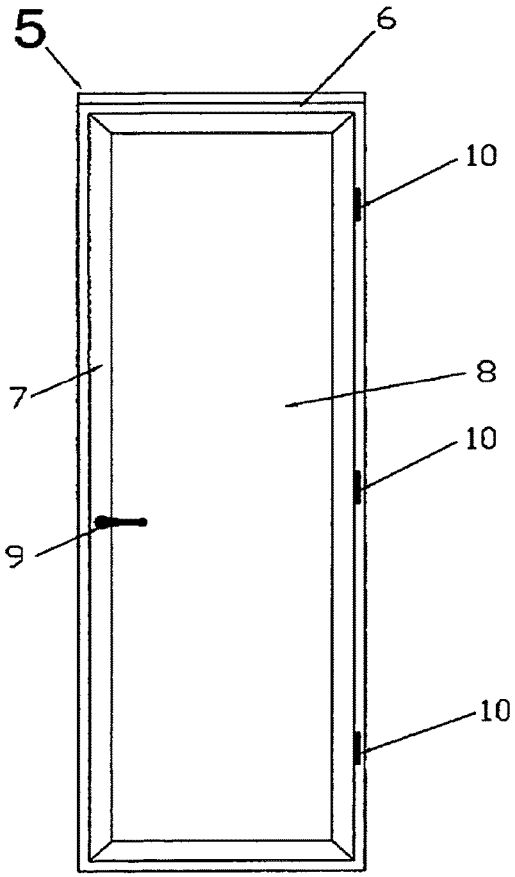
FIG. 2A is a front view of a first preferred embodiment of the present invention temporary portable abatement, remediation, demolition, and remodeling door/frame assembly showing its door panel/frame hinged to, and closed against, a surrounding outer frame portion, with the door panel/frame also having a handle positioned centrally on its left side.
Figure 2B:
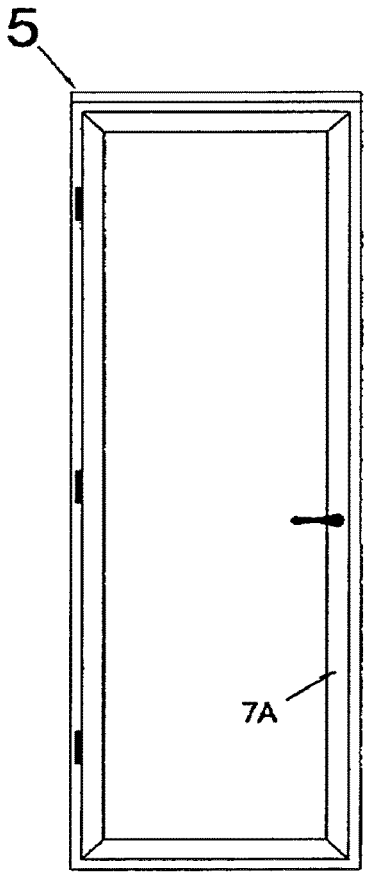
FIG. 2B is a front view of a second preferred embodiment of the present invention showing its door panel/frame hinged to, and closed against, a surrounding outer frame portion, with the door panel/frame also having a handle positioned centrally on its right side.
Figure 5:
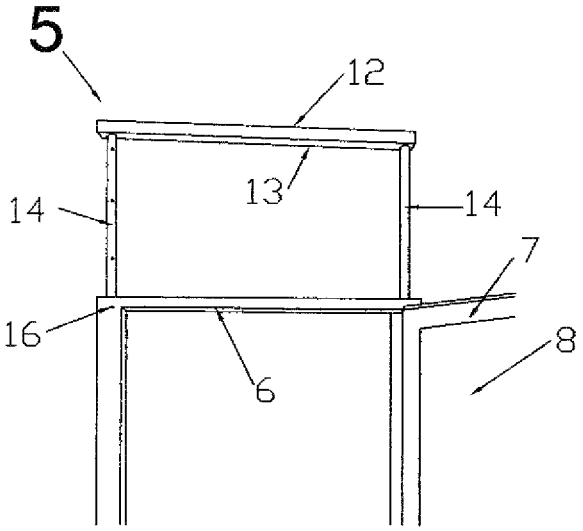
FIG. 5 is a front view of the top portion of the door/frame assembly in the first preferred embodiment of the present invention, showing a top extension having two non-biased side members and a top bar connected to and between the top ends of the side member, with the extension raised higher above the top of the assembly's outer frame portion than is shown in FIG. 4.
Figure 6:
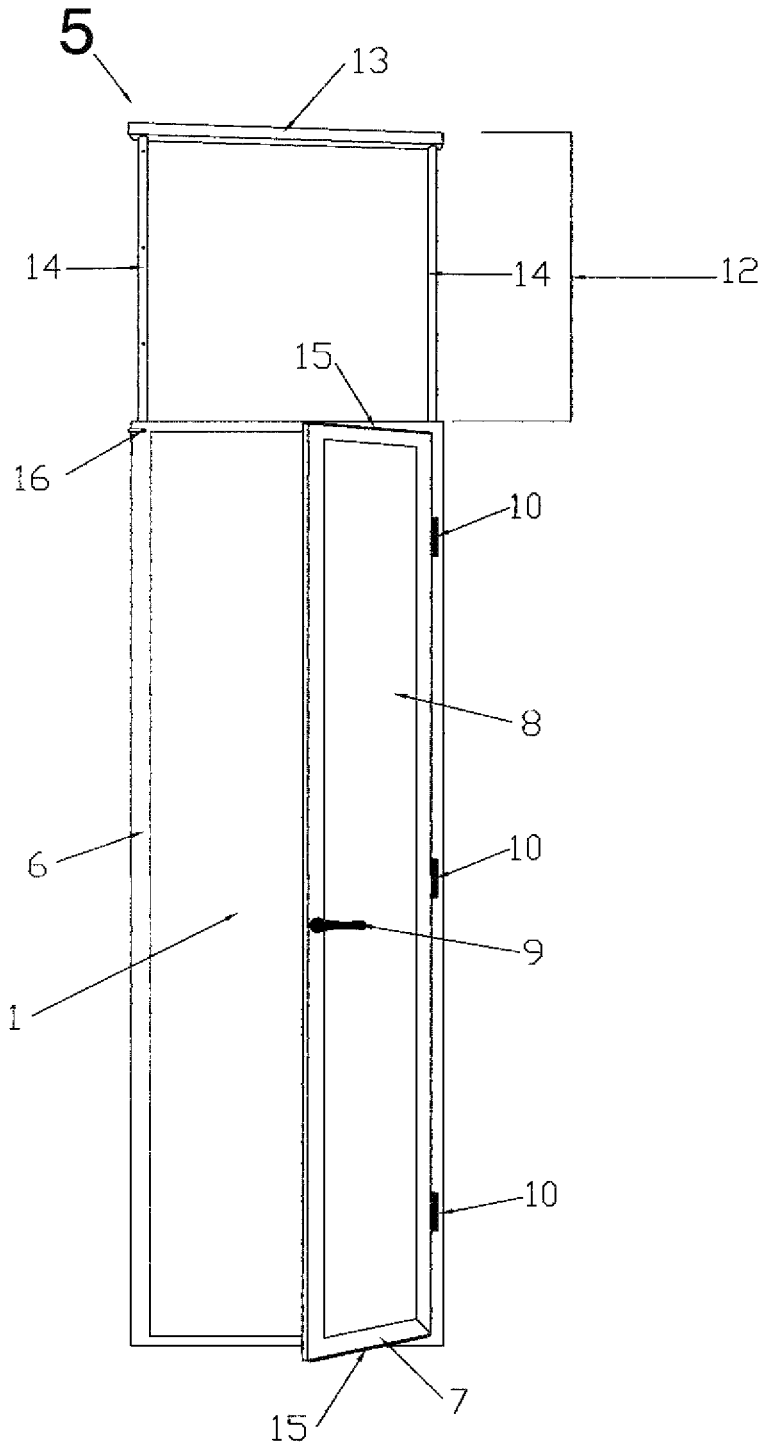
FIG. 6 is a front view of the first preferred embodiment of the present invention door/frame assembly having its door panel/frame partially open and its top bar raised to near full extension.
Figure 7:
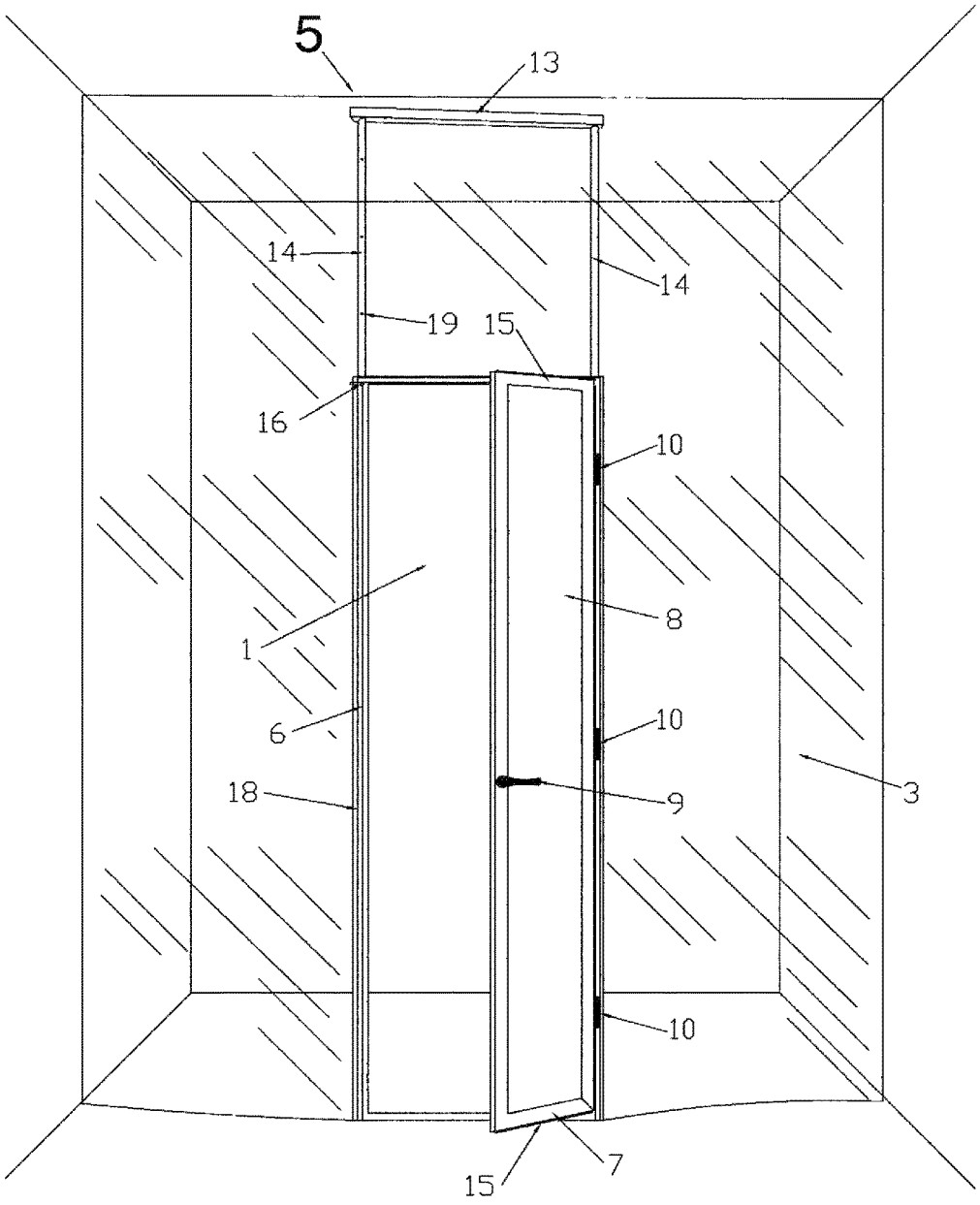
FIG. 7 is a front view of the first preferred embodiment of the present invention door/frame assembly surrounded by a temporary flexible sheet barrier, double face tape securing the sides of the present invention's outer frame portion to the barrier, and its top bar raised and secured to a ceiling behind the barrier with locking pins, fasteners, tape, and/or other means.
Figure 8:
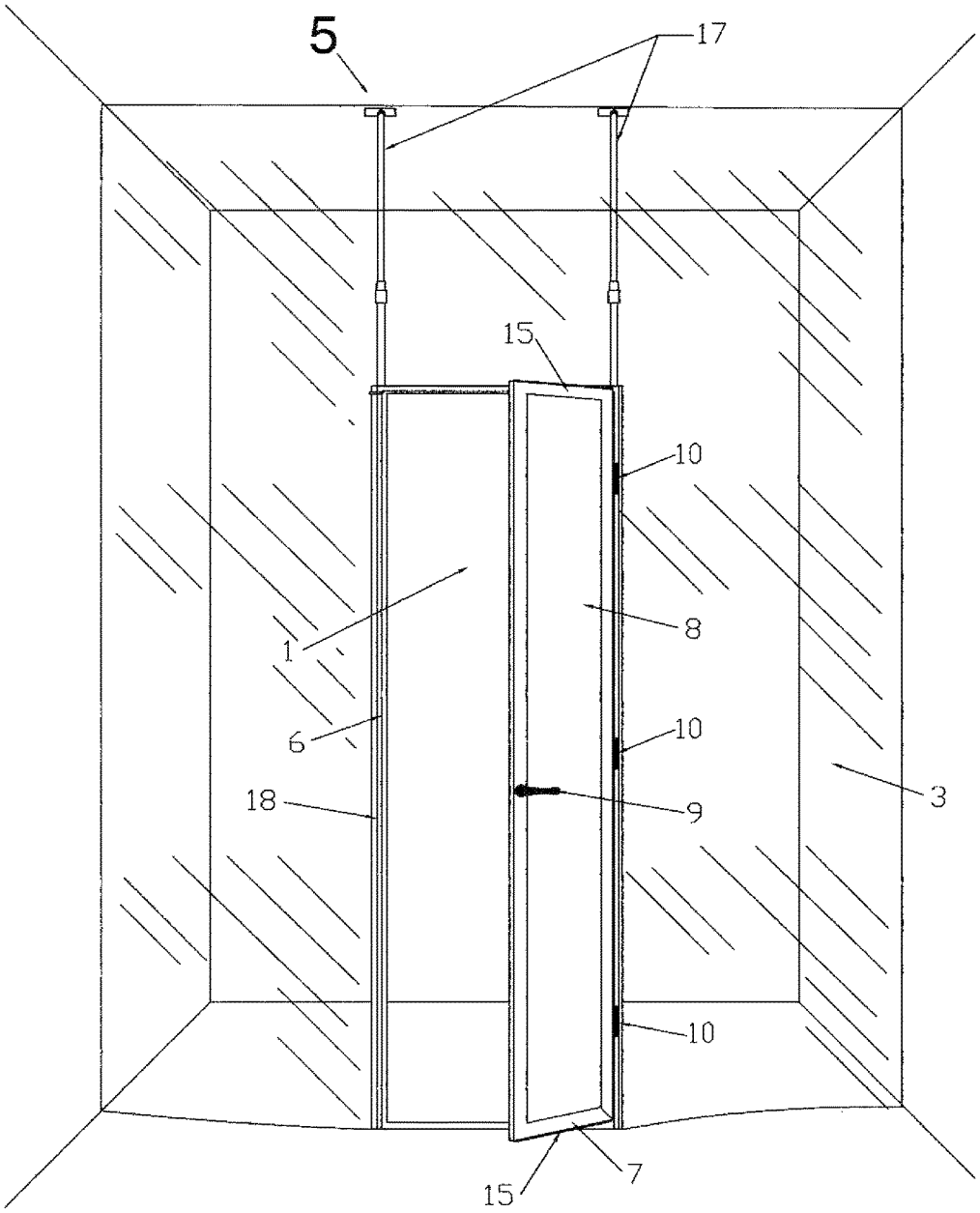
FIG. 8 is a front view of the first preferred embodiment of the present invention door/frame assembly surrounded by a temporary flexible sheet barrier, double face tape securing the sides of the present invention's outer frame portion to the barrier, and its top extension replaced by spring-loaded/biased telescoping poles that are shown secured against a portion of the ceiling behind the barrier without any fasteners.

FIGS. 2A-8 show various views of the present invention temporary portable abatement/remediation/demolition/remodeling door/frame assembly 5, with FIGS. 7 and 8 showing door/frame assembly 5 during use. FIG. 2A is a front view of a first preferred embodiment of the present invention temporary portable abatement/remediation door/frame assembly 5 showing its door (panel 8 and frame 7) hinged to, and closed against, a surrounding outer frame portion 6, with the door (7/8) also having an exterior door handle 9 positioned centrally on its left side, within easy reach of a person attempting to open door (7/8) when unlocked and pass through outer frame portion 6 to enter or exit a limited access area. A top extension 12, having a top bar 13 and opposed, laterally positioned, and non-spring-loaded vertical side members 14, is shown in FIGS. 4-8 extending upwardly from the top end of outer frame portion 6. FIG. 2B is a front view of a second preferred embodiment of the present invention showing its door (7/8) hinged to, and closed against, the opposing side of outer frame portion 6 so that its door (7/8) swings open in the opposed direction from the door (7/8) shown in the first preferred embodiment of door/frame assembly 5 shown in FIG. 2A. The door (7/8) in FIG. 2B also has its exterior door handle 9 positioned centrally on its right side, instead of the left side shown in FIG. 2A. Doors (7/8) in both embodiments of the present invention can be installed to open both inwardly and outwardly, depending on convenience or need. In addition, although not shown, door closure means can also be employed as a part of the present invention door/frame assembly 5 to minimize delay for technician ingress/egress. Although the proportional dimensions of panel 8 to door frame 7 are shown to be the same in FIGS. 2A and 2B, the dimensions shown are not critical to the present invention. Also, the proportional dimensions of door (7/8) to outer frame 6 are shown to be the same in FIGS. 2A and 2B, and the dimensions shown are merely provided as an example and are not critical to the present invention as long as it remains lightweight, easily carried by one person, and able to fulfill its intended function. Furthermore, the size, configuration, and placement of the handle 9 in present invention door/frame assembly 5 is not limited to that shown in FIGS. 2A and 2B. In addition, the number, size, placement, spaced-apart distance, type, and configuration of the hinges 10 used in the present invention door/frame assembly 5 is also provided only as an example and is not considered as critical or limited to the representation shown in FIGS. 2A and 2B.

Figure 3:
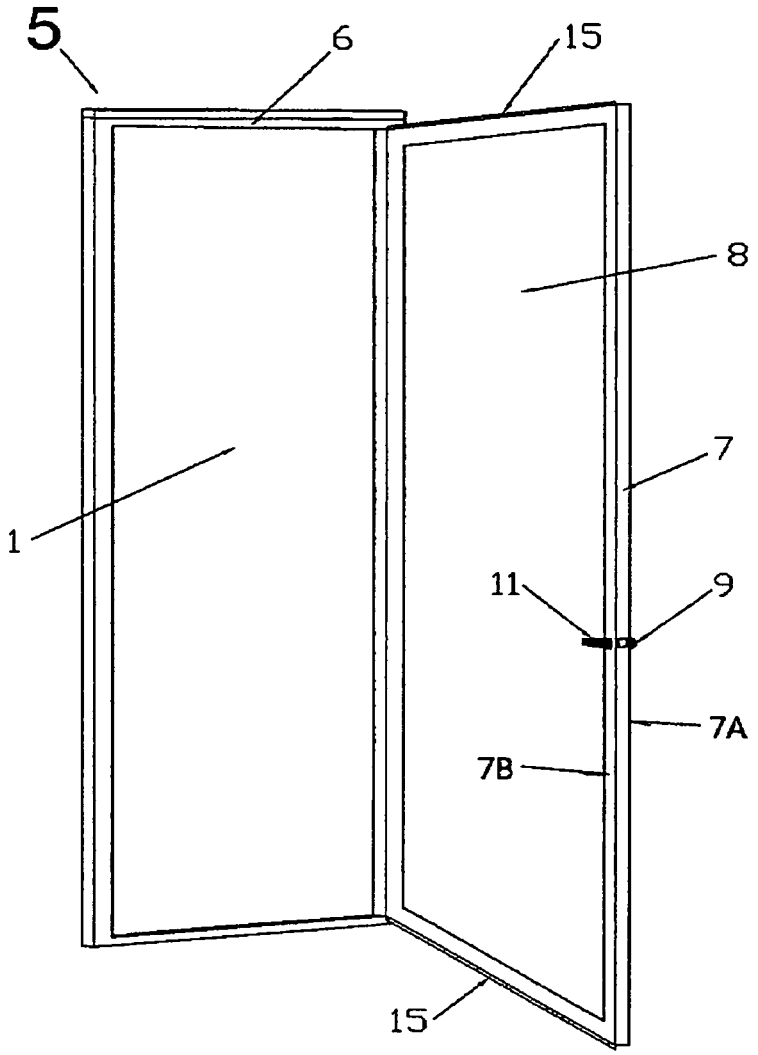
FIG. 3 is a perspective view of the first preferred embodiment of the present invention with its door panel/frame partially opened and showing handles on both sides of the door.

FIG. 3 is a perspective view of the first preferred embodiment of the present invention door/frame assembly 5 with its door (7/8) partially opened and showing handles (9 and 11) in opposed positions on the opposite sides of door (7/8). Handle 9 or 11 preferably contains a locking mechanism that may be selectively locked, or it can be configured to require keyed entry at all times, according to need in the current application. In addition, although not shown, at least one deadbolt or other lock may be connected between door (7/8) and outer frame 6 in addition to a locking mechanism in handles 9 and/or 11, or in place of a locking mechanism in handles 9 and/or 11. Furthermore, FIG. 3 shows seals 15 used on the top and bottom ends of door frame part 7 as a further precaution toward reducing the air transmission from one side of door/frame assembly 5 to the other. The number, size, placement, and configuration of seals 15 used as a part of present invention door/frame assembly 5 is not limited to that shown in FIG. 3.

Figure 4:
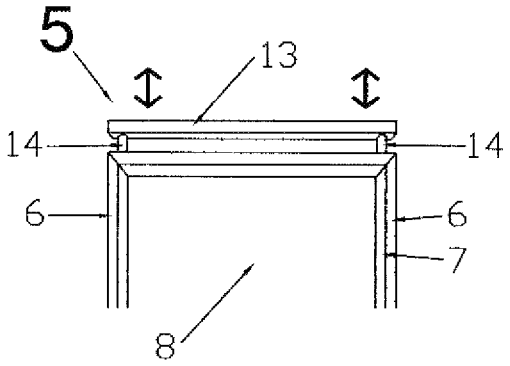
FIG. 4 is a perspective view from the bottom of the top portion of the door/frame assembly in the first preferred embodiment of the present invention and showing a top extension having two non-biased side members and a top bar that can be raised upwardly away from the top surface of the assembly's outer frame portion for additional support of the present invention from a header, ceiling, or other overhead surface/location, with double-headed arrows showing the direction of raising and lowering for the top bar.

FIGS. 4-6 show varying representations of upward separation of the top bar 13 of top extension 12 away from the top end of outer frame portion 6, with double-headed arrows in FIG. 4 showing the direction of top extension 12 movement. As can be easily observed, FIG. 4 has the least separation of top bar 13 and outer frame portion 6, wherein a large portion of each vertical side member 14 remains hidden within outer frame portion 6, FIG. 5 has a moderate amount of separation between top bar 13 and outer frame portion 6 and shows more of the vertical side members 14 in view, and FIG. 6 has the largest amount of separation between top bar 13 and outer frame portion 6 and even more of each vertical side member 14 in view when compared to FIG. 5. In addition, FIGS. 4-6 each identify the vertical side members 14, with FIGS. 4 and 5 showing spaced-apart holes (represented in FIG. 7 with the number 19) in vertical side members 14 that allow them to be locked at selected elevations with the locking pins 16 shown in FIGS. 5 and 6. The number, positioning and spaced apart distance of the holes 19 are not limited to the representations shown in FIGS. 5-7. FIG. 4 is a perspective view from the bottom of the top portion of the door/frame assembly 5 in the first preferred embodiment of the present invention and showing a top extension (13/14, also marked in FIGS. 5 and 6 by the number 12) having two non-spring-loaded/non-biased vertical side members 14 and a top bar 13 that can be raised upwardly and away from the top of the outer frame portion 6 for additional support of the present invention assembly 5 from a header, ceiling, or other overhead location (such as but not limited to those shown in FIGS. 1 and 1A). Although not shown, top bar 13 may have pre-drilled holes allowing secured fastened connection to a header, ceiling, or other overhead location. In addition or in the alternative, top bar 13 may be taped to a header, ceiling, or other overhead location. FIG. 5 is a front view of the top portion of the door/frame assembly 5 in the first preferred embodiment of the present invention, showing a top extension 12 having two non-spring-loaded/non-biased vertical side members 14 and a top bar 13 connected across and between the top ends of vertical side members 14, with the top extension 12 raised higher above the top of outer frame portion 6 than is shown in FIG. 4. The locking pin 16 shown in FIG. 5 is secured to a hidden hole 19 (see FIG. 7 for the designation/number 19) in the adjacent vertical side member 14. Furthermore, although FIGS. 5-7 only show holes 19 in one of the vertical side members 14, both may have holes 19, depending upon the application. FIG. 6 is a front view of the first preferred embodiment of the present invention having its door partially open and its top bar 13 elevated to near full extension. FIG. 6 also shows the seals 15 that can be used with the top and bottom surfaces of door frame 7, hinges 10, door handle 9, the temporary opening 1 in outer frame portion 6 through which one can pass when door (7/8) is in an opened configuration, and one of the locking pins 16 that can be used with holes 19 (see the number 19 in FIG. 7) to lock side members 14 at a pre-selected elevation. Also, the configurations and proportional dimensions of top bar 13 and vertical side members 14 are merely shown as an example in FIGS. 4-7, the actual configurations and dimensions of them are not critical to the present invention and may differ from shown.

FIGS. 7 and 8 show the present invention door/frame assembly 5 during use while secured to a temporary sheet barrier 3. FIG. 7 is a front view of the first preferred embodiment of the present invention surrounded by a flexible temporary sheet barrier 3, and with double face or Ezier™ tape 18 securing the sides of outer frame portion 6 to the temporary barrier 3. FIG. 7 also shows top bar 13 raised and secured to a ceiling behind temporary barrier 3, with a locking pin 16 fixing side members 14 at a pre-selected elevation. FIG. 7 also shows the seals 15 that can be used with the top and bottom surfaces of door frame portion 7, the hinges 10 movable between door frame portion 7 and outer frame portion 6, door handle 9, and the temporary opening 1 in outer frame portion 6 through which one can pass when door (7/8) is in an opened configuration. Although not shown in FIG. 7, the top bar 13 of top extension 12 can also help secure the top edge of temporary barrier 3 against a ceiling or other overhead surface. In contrast, FIG. 8 is a front view of the first preferred embodiment of the present invention door/frame assembly 5 surrounded by a temporary sheet barrier 3 and double face tape or Ezier™ tape 18 securing the sides of the present invention's outer door frame 6 to the temporary barrier 3, however, its top extension 12 is replaced by prior art spring-loaded/biased telescoping poles 17 individually secured against a portion of the ceiling behind temporary barrier 3. Although not shown in FIG. 8, prior art spring-loaded/biased telescoping poles 17 can also secure the top edge of temporary barrier 3 against a ceiling or other overhead surface with a pad or an elongated foam rail. Typically, top extension 12 is removed from top holes (not shown) in outer frame portion 6 and prior art spring-loaded/biased telescoping poles 17 are substituted in place of the vertical side members 14 in top extension 12. Since the present invention door/frame assembly 5 is portable, during its installation door (7/8) can be oriented to have a left or right hand in-swing or a left or right hand out-swing, according to preference or need.

The present invention door/frame assembly 5 does not require assembly by a user prior to installation, and is designed for repeat use. It is easier and faster to use than the commonly disposable prior art zippered door entrances, and is responsible for less environmental impact. It also reduces back injury and tripping risk for people entering into and exiting from a limited access area over zippered door entrance use. The bottom surface of outer frame portion 6 may be secured with double face tape or Ezier™ tape 18 to the floor or other surface supporting door/frame assembly 5, single face tape may be used to otherwise secure the lower portion of outer frame portion 6 to a floor or other supporting surface, or fasteners may be used to secure the lower portion of outer frame portion 6 into a sub-floor (not shown). As mentioned above, top bar 13 may be secured by fasteners, tape, or other means to an overhead surface, in addition to, or in place of using locking pin 16 and holes 19 for selection of an elevation for top bar 13. Periodically, the hinges 10 and door latches 9 and 11 of the present invention door/frame assembly 5 should be lubricated. Replaceable parts may include the seals 15 secured to the top and bottom surfaces of door frame 7. Also, door/frame assembly 5 should be cleaned and inspected prior to each use to make certain containment will be achieved. After each use, door/frame assembly 5 should be decontaminated for any dust, asbestos, lead, or mold present, as needed, with the cost thereof part of the building owner's expense for the abatement, remediation, demolition, and/or remodeling work. In addition, although the present invention door/frame assembly 5 is more expensive to manufacture and purchase than a plastic Zipwall® doorway kit (or similar product), with repeat use the present invention door/frame assembly 5 could pay for itself after a few uses, for example by billing an insurance carrier or building owner the current purchase price of a plastic Zipwall® doorway kit (or similar product) for each use. Manufacture of the present invention door/frame assembly 5 using screws, other fasteners, and/or welding produces a substantial and durable product, which may have a clear door panel 8, or not, depending upon the application.

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, but instead encompassing all embodiments and methods within the scope and spirit of the invention, as defined in the accompanying claims.

I claim:

1. A reusable, portable, and reversible temporary door and frame assembly blocking unauthorized access into construction areas and primarily used in abatement, remediation, demolition, and remodeling applications with an underneath supporting surface, an overhead surface, and a walkway opening leading to a construction area, said door and frame assembly comprising:

an outer frame portion having a top end, opposing sides, and a bottom end;

a door with an upper end and an opposed lower end, said door also having hinged connection to one of said opposing sides of said outer frame portion allowing movement of said door relative to said outer frame portion between a closed position against said outer frame portion and opened positions creating a temporary walkway access through and between said top end, said opposing sides, and said bottom end of said outer frame portion;

a generally C-shaped top extension having two non-spring-loaded poles each with a top end and an opposed bottom end, said top extension also having a top bar connected across and between said top ends of said two poles, said bottom ends of said poles associated with said outer frame portion for repeat upward and downward elevation change of said top bar toward and away from said outer frame portion wherein differing portions of said poles remain hidden from view within said outer frame portion; and a door handle allowing on-demand movement of said door between said closed position against said outer frame portion and at least one of said opened positions, wherein when said temporary door and frame assembly is positioned in front of said walkway opening leading to said construction area, said bottom end of said outer frame portion is temporarily secured to a supporting surface in a manner eliminating air transmission around said bottom end, said top bar of said top extension is temporarily secured to an overhead surface in a manner eliminating air transmission around said top bar, and said opposing sides are temporarily secured to eliminate air transmission around them, said door and frame assembly can provide containment of potentially harmful substances within, and block unauthorized access to, the construction area, and after association with said walkway opening leading to said construction area, said assembly can be promptly and easily relocated for reuse.

2. The portable door and frame assembly of claim 1 further comprising at least one top seal depending from said upper end of said door and at least one bottom seal depending from said lower end of said door, reducing air transmission around said door when said door is in said closed position.

3. The portable door and frame assembly of claim 1 wherein said door further comprises a door panel with a perimeter and a door frame depending outwardly from said perimeter.

4. The portable door and frame assembly of claim 3 wherein said door panel is opaque.

5. The portable door and frame assembly of claim 3 further comprising at least one top seal depending from said door frame and at least one bottom seal depending from said door frame, reducing air transmission around said portable door and frame assembly when said door is in said closed position.

6. The portable door and frame assembly of claim 1 wherein said door handle further comprises at least one lock.

7. The portable door and frame assembly of claim 1 wherein said door has a back surface facing said outer frame portion when said door is in said closed position against said outer frame portion and an opposed front surface remote from said outer frame portion when said door is in said closed position, and further wherein said door handle is a two-part handle connectable through said door for on-demand movement of said door from positioning adjacent to both said front and back surfaces of said door.

8. The portable door and frame assembly of claim 1 wherein said outer frame portion, said door, and said top extension are made from lightweight materials.

9. The portable door and frame assembly of claim 1 wherein said top end of said outer frame portion is configured to accept one or more upwardly extendable spring-loaded poles as a substitute for said top extension.

10. The portable door and frame assembly of claim 1 wherein said hinged connection of said door to one of said opposing sides of said outer frame portion is selected from a group consisting of hinged connections allowing said door to open inwardly, hinged connections allowing said door to open outwardly, hinged connections allowing right swing of said door, and hinged connections allowing left swing of said door.

11. The portable door and frame assembly of claim 1 wherein said top extension is separable from said outer frame portion.

12. The portable door and frame assembly of claim 1 wherein said top extension is lockable at selected elevations above said top end of said outer frame portion.

13. The portable door and frame assembly of claim 12 further comprising at least one locking pin, and wherein at least one of said non-spring-loaded poles of said top extension has a plurality of receiving holes for said at least one locking pin.

14. A reusable, portable, and reversible temporary door and frame assembly blocking unauthorized access into construction areas and primarily used in abatement, remediation, demolition, and remodeling applications with an underneath supporting surface, an overhead surface, and a walkway opening leading to a construction area, in permanent structures and temporary barriers, and said door and frame assembly comprising:

an outer frame portion having a top end, opposing sides, and a bottom end;

a door having a door panel with a perimeter and a door frame depending outwardly from said door panel, said door frame also having an upper end and an opposed lower end, said door further having hinged connection to one of said opposing sides of said outer frame portion allowing movement of said door relative to said outer frame portion between a closed position against said outer frame portion and opened positions creating a temporary walkway access through and between said top end, said opposing sides, and said bottom end of said outer frame portion;

a generally U-shaped top extension having two non-spring-loaded poles each with a top end and an opposed bottom end, said top extension also having a top bar connected across and between said top ends of said two poles, said bottom ends of said poles associated with said outer frame portion for repeat upward and downward elevation change of said top bar toward and away from said outer frame portion wherein differing portions of said poles remain hidden from view within said outer frame portion;

at least one top seal depending from said upper end of said door frame and at least one bottom seal depending from said lower end of said door frame, reducing air transmission through said temporary walkway access when said door panel and said door frame are in said closed position; and a door handle allowing on-demand movement of said door between a closed position within and against said outer frame portion and at least one of said opened positions creating said temporary walkway access through and between said top end, said opposing sides, and said bottom end of said outer frame portion, wherein when said bottom end of said outer frame portion has temporary airtight connection to said underneath supporting surface, said top bar of said top extension has temporary airtight connection to said overhead surface, and said opposing sides of said outer frame portion have temporary airtight connection in said walkway opening leading to said construction area, said outer frame portion, said door, and said top extension provide containment of potentially harmful substances within, and block unauthorized access to, the construction area, and after association with said walkway opening leading to said construction area, said assembly can be promptly and easily relocated for reuse.

15. The portable door and frame assembly of claim 14 wherein said door panel is opaque.

16. The portable door and frame assembly of claim 14 wherein said door handle is selected from a group consisting of lockable door handles and two-part handles connectable through said door.

17. The portable door and frame assembly of claim 14 wherein said outer frame portion, said door, and said top extension are made from lightweight materials.

18. The portable door and frame assembly of claim 14 wherein said top end of said outer frame portion is configured to accept one or more upwardly extendable spring-loaded poles as a substitute for said top extension.

19. The portable door and frame assembly of claim 14 wherein said hinged connection of said door to one of said opposing sides of said outer frame portion is selected from a group consisting of hinged connections allowing said door to open inwardly, hinged connections allowing said door to open outwardly, hinged connections allowing right swing of said door, and hinged connections allowing left swing of said door.

20. The portable door and frame assembly of claim 14 wherein said top extension is separable from said outer frame portion.

* * * * *